US006287215B1

(12) United States Patent
Fisher

(10) Patent No.: US 6,287,215 B1
(45) Date of Patent: Sep. 11, 2001

(54) GOLF PUTTER WITH ADJUSTABLE LIE AND LOFT ANGLES

(76) Inventor: Dale P. Fisher, 18055 Bushard, Fountain Valley, CA (US) 92708

( * ) Notice: Subject to any disclaimer, the term of this patent is extended or adjusted under 35 U.S.C. 154(b) by 0 days.

(21) Appl. No.: 09/448,982

(22) Filed: Nov. 24, 1999

(51) Int. Cl.[7] ..... A63B 53/02
(52) U.S. Cl. ..... 473/309; 473/313; 473/314
(58) Field of Search ..... 473/313, 309, 473/305–308, 310–312, 314–315

(56) References Cited

U.S. PATENT DOCUMENTS 3,191,936 * 6/1965 Guier .
5,184,819 * 2/1993 Desbiolles .
5,626,528 * 5/1997 Toulon ..... 473/248
5,792,007 * 8/1998 Billings ..... 473/305

* cited by examiner

*Primary Examiner*—Jeanette Chapman
*Assistant Examiner*—Stephen L. Blau
(74) *Attorney, Agent, or Firm*—William L. Chapin

(57) ABSTRACT

A golf putter is provided in which the lie and/or loft angle thereof may be semi-permanently but reversibly adjusted by a golfer prior to playing, to suit the individual golfer's stance, swing dynamics, playing skill and/or condition of the greens on which the golfer intends to play. An adjustable lie/loft angle putter according to the present invention includes a hollow tubular shaft and a head coupled together by a reversibly bendable coupling element which preferably is fabricated from a relatively ductile metal such as stainless steel which is formed into an elongated, hollow tube which has a circular cross section. A first, upper longitudinal end of the coupling element is insertably received in the lower opening of a bore within the shaft, while the other end of the coupling element is attached directly to the putter head or to a hosel protruding from the head. At least an intermediate portion of the coupling element is sufficiently flexible to allow it to be bent to a contour which provides desired lie/loft angles, by force applied to the shaft while the head is held immobile.

35 Claims, 4 Drawing Sheets

GOLF PUTTER WITH ADJUSTABLE LIE AND LOFT ANGLES

BACKGROUND OF THE INVENTION

1. Field of the Invention

The present invention relates to golf putters. More particularly, the invention relates to an improved golf putter construction which allows both the lie angle and loft angle of a putter to be semi-permanently adjusted or customized by an individual golfer to suit his or her requirements.

2. Description of Background Art

The lie angle of a golf club such as a putter is generally defined as the angle between the ground and the shaft, with the bottom surface or sole of the putter head in flat contact with the ground. This angle is of substantial importance in determining the putting accuracy and success of an individual golfer, for the following reasons.

Preparatory to striking a golf ball resting on a green to propel it towards the cup, a customary and recommended orientation of the golfers body includes facing or addressing the ball along a line perpendicular to a line directed from the ball to the cup, i.e., perpendicular to the direction in which the ball is to be propelled Also, the grip at the upper end of the putter shaft is usually grasped between the hands with the lower end of the shaft angled forward away from the golfer's body, thus positioning the head of the putter behind the ball. Once the putter head is aligned behind the ball with the face of the putter perpendicular to an intended initial roll direction of the ball, the arms are swung rearward to a cocked position, and swung forward to impact and launch the ball. Each individual golfer will, of course, have a preferred stance which feels comfortable to him or her, and will thus tend to address the ball in a more or less stooped orientation of the torso with respect to the legs. Thus, to help insure that the sole of the putter head remains parallel to the ground, putters are customarily provided with shaft lengths which may be selected from a small number of lengths, e.g., 28", 30" and 32", for short, intermediate height and tall golfers, respectively. This shaft length selectability helps to insure that the sole of the putter will be kept parallel to the green surface. However, because of the variation in physical dimensions, as well as stances of golfers, there still remains for many golfers a problem in maintaining the putter sole horizontal. One solution to the problem is to provide a golf putter with a lie angle that is customized by the putter manufacturer to a particular golfer's specifications. However, this approach is less than completely satisfactory for two main reasons. First, the time delay and cost of waiting for a club to be customized is undesirable. Second, many beginning golfers change their stances as they become more experienced, and are therefore not quite sure which lie angle/shaft length combination to choose.

Another mechanical parameter of golf putters which has an important effect on putting performance is the loft angle of the putter. The loft angle is defined as the rearward inclination angle of the club face from the shaft axis. Thus, with a small positive loft angle, e.g., 2–3 degrees, the impact vector, when the ball is struck with the shaft vertically oriented, will have a small, upward component. A small positive loft angle is generally desirable to keep the ball from being inadvertently driven downward into the green surface by the golfer, thus, starting the ball with a bounce, decreasing both its intended roll distance and directional accuracy. However, if the loft angle is too large, the ball will tend to jump off the face of the putter, also decreasing control of distance and path accuracy. Depending upon a given golfer's stance, the true loft angle at the time of ball impact can vary substantially from the static value measured between the club face and shaft. Also, depending upon a particular greens condition, it may be desirable to vary the loft angle. For the reasons set forth above, it would be desirably to provide a golf putter in which the lie angle and/or loft angle may be varied by the golfer to customize the putter for his use and/or to suit differing greens conditions.

In U.S. Pat. No. 5,803,824, Rollingson, a golf putter with lie and offset adapter is disclosed in which the offset, i.e., horizontal spacing between the shaft axis and the bottom end of the front face of the putter, and lie angle are selectively set during factory assembly of the putter, by an adapter. The adapter has an upper elongated portion adapted to fasten to the lower end of a putter shaft and which lies generally in a vertical plane, an intermediate spacer portion which lies generally in a horizontal plane, and a lower elongated portion which is adapted to attach to a putter head or hosel and which lies in a generally vertical plane, the longitudinal axis of which is laterally offset from and angled with respect to the longitudinal axis of the upper portion, at a preselected offset distance and lie angle, respectively.

The present inventor is unaware of any existing golf putters in which the lie angle may be readily adjusted and re-adjusted by an individual golfer, without having to send the club to a pro-shop or manufacturer. Moreover, the present inventor is unaware of any existing golf putter in which the loft angle may be readily adjusted and re-adjusted by an individual golfer. In view of the unavailability of the foregoing features in existing golf putters, the present invention was conceived of.

OBJECTS OF THE INVENTION

An object of the present invention is to provide a golf putter which has a head and shaft coupled together by a bendable coupling element which may be bent to adjust the lie angle of the head sole with respect to the longitudinal axis of its shaft.

Another object of the invention is to provide a golf putter which has a head and shaft coupled together by a bendable coupling element which may be bent to adjust the loft angle of the head face with respect to the longitudinal axis of the shaft.

Another object of the invention is to provide a golf putter which has a head and shaft coupled together by a bendable coupling element which may be bent in different directions to adjust the lie and loft angles, respectively, of the putter head relative to the shaft.

Another object of the invention is to provide a golf putter which has a head and shaft coupled together by a bendable coupling element which may be reversibly bert in different directions to adjust and re-adjust the lie and loft angles, respectively, of the putter head relative to the shaft.

Another object of the invention is to provide a golf putter which has a head and shaft coupled together by a bendable coupling element of a length selectable to achieve an overall club length and which may be reversibly bent to achieve desired lie and loft angles.

Another object of the invention is to provide a coupling element for coupling a putter shaft to a putter head which is reversibly bendable to achieve desired lie and loft angles.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a golf putter in which the lie angle and loft angle of the putter may be reversibly adjusted by a golfer, to suit his or her particular stance, swing dynamics, playing skill and/or type or condition of the greens of the courses which the golfer intends to play.

A golf putter with adjustable lie and loft angles according to the present invention includes a shaft and head coupled together by a reversibly bendable coupling element, or coupler. A preferred embodiment of a coupler according to the present invention includes a longitudinally elongated, radially symmetric solid rod or hollow tube which preferably has a circular cross section. A first, upper end of the coupler is of a shape and size which is adapted to be insertably received and retained in the lower opening of a bore within a hollow tubular shaft, and retained therein by an interference fit, adhesive bond such as epoxy glue, or a mechanical fastener such as a set screw. The second, lower end of the coupler is adapted to attach to a golf putter head or hosel , by being insertably received and held with a bore on the head or hosel, in a manner similar to that of attaching the upper end of the coupler to the shaft. Alternatively, the lower end portion of the coupler is provided with a bore for insertably receiving a hosel, and secured thereto by an interference fit, adhesive bond, or set screw.

According to the present invention, at least an intermediate longitudinal portion of the coupler is made of a bendable or malleable material such as stainless steel In a preferred embodiment, the coupler is made of thin-wall stainless steel tubing, which has a larger diameter lower portion adapted to attach to a hosel, a lower insertion-depth limiting flange, a bendable intermediate portion, an upper smaller diameter flange and an upper portion adapted to be insertably received within a shaft bore to a depth limited by the upper flange.

According to another aspect of the invention, at least part of the hollow interior of a tubular coupler which is bendable to adjust the lie and loft angles of the putter may contain a cylindrical plug of a different material, such as lead or polyurethane, to allow the weight balance or vibration dampening characteristics of the club to be adjusted, and/or to prevent kinking of the coupler during bending.

According to the present invention, the bendability of the coupler is sufficient to permit the lie and loft angles to be adjusted with application of a substantial force greater than forces encountered during normal play, and for at least several cycles.

DESCRIPTION OF THE PREFERRED EMBODIMENTS

Referring now to FIGS. 1–11, a golf putter with adjustable lie and loft angles according to the present invention is shown.

Figure 1:
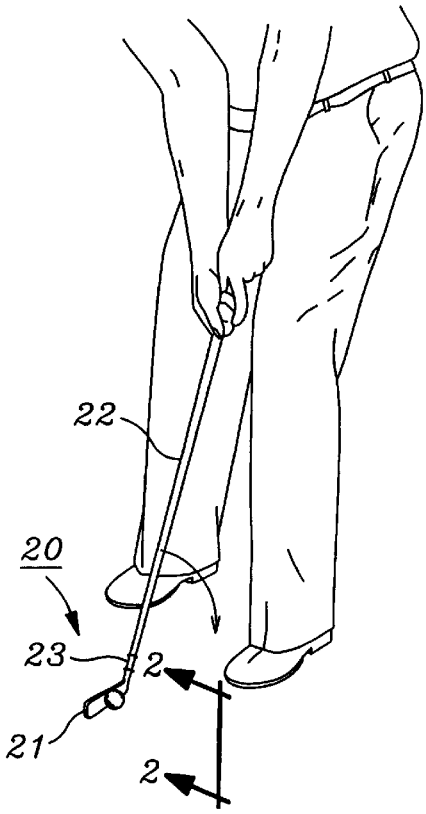
FIG. 1 is a front perspective view of a golf putter with adjustable lie and loft angles according to the present invention, showing the putter being held by a golfer and used to impact a golf ball.
Figure 2:
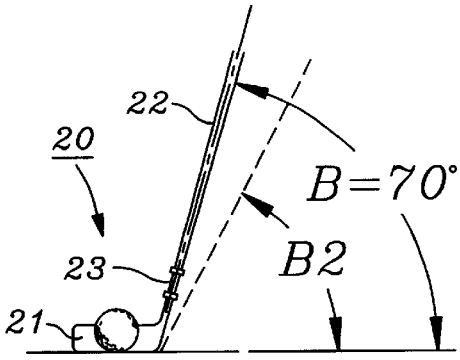
FIG. 2 is a fragmentary front elevation view of the putter of FIG. 1, on an enlarged scale.

Referring first to FIGS. 1 and 2, an adjustable leadoff angle putter 20 according to the present invention, may be seen to include a head 21 coupled to a shaft 22 by a coupler 23. As shown in FIGS. 1 and 5, head 21 of putter 20 includes a body 24 which has a generally flat or slightly convex lower surface or sole 25 which rests horizontally on a green surface A, in tangential contact therewith. As shown in FIGS. 1, 2 and 5A, body 24 of putter head 21 has a generally flat front surface 26, the central lateral portion 27 of which is intended to impact a golf ball. Referring still to FIGS. 1 and 5A, it may be seen that putter 20 is provided with a hosel 29 which protrudes obliquely, i.e., upwardly and rightwardly, from the upper surface 30 of putter head body 24. The junction 31 of hosel 29 with upper putter head surface 30 is located laterally between the center and right-hand side or heel 32 of the putter head, but could also be located closer towards the left-hand side or toe 33 of the head.

As shown in FIG. 1, hosel 29 has a hollow tubular construction which includes an upper entrance bore 35 which normally would receive the lower end of shaft 22, but in the present case, receives the lower end of coupler 23. However, as will be explained in further detail below, hosel 29 could also be of solid construction. In any event, with sole 25 of putter 20 horizontally contacting green surface A, as shown in FIGS. 2 and 5A, the longitudinal axis of hosel 29, and therefore of attached shaft 22, is inclined at an acute angle B to the sole and green surface. In most cases this lie angle B would be about 70 degrees for an average golfer assuming an average stance.

Figure 3:
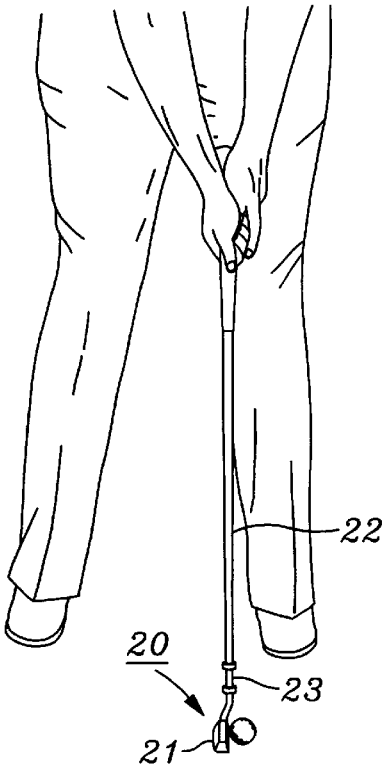
FIG. 3 is a right side elevation view of the putter and golfer of FIG. 1.
Figure 4:
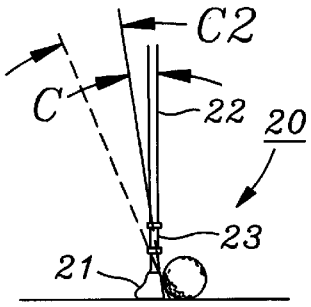
FIG. 4 is a fragmentary right side elevation view of the putter of FIG. 3.
Figure 6:
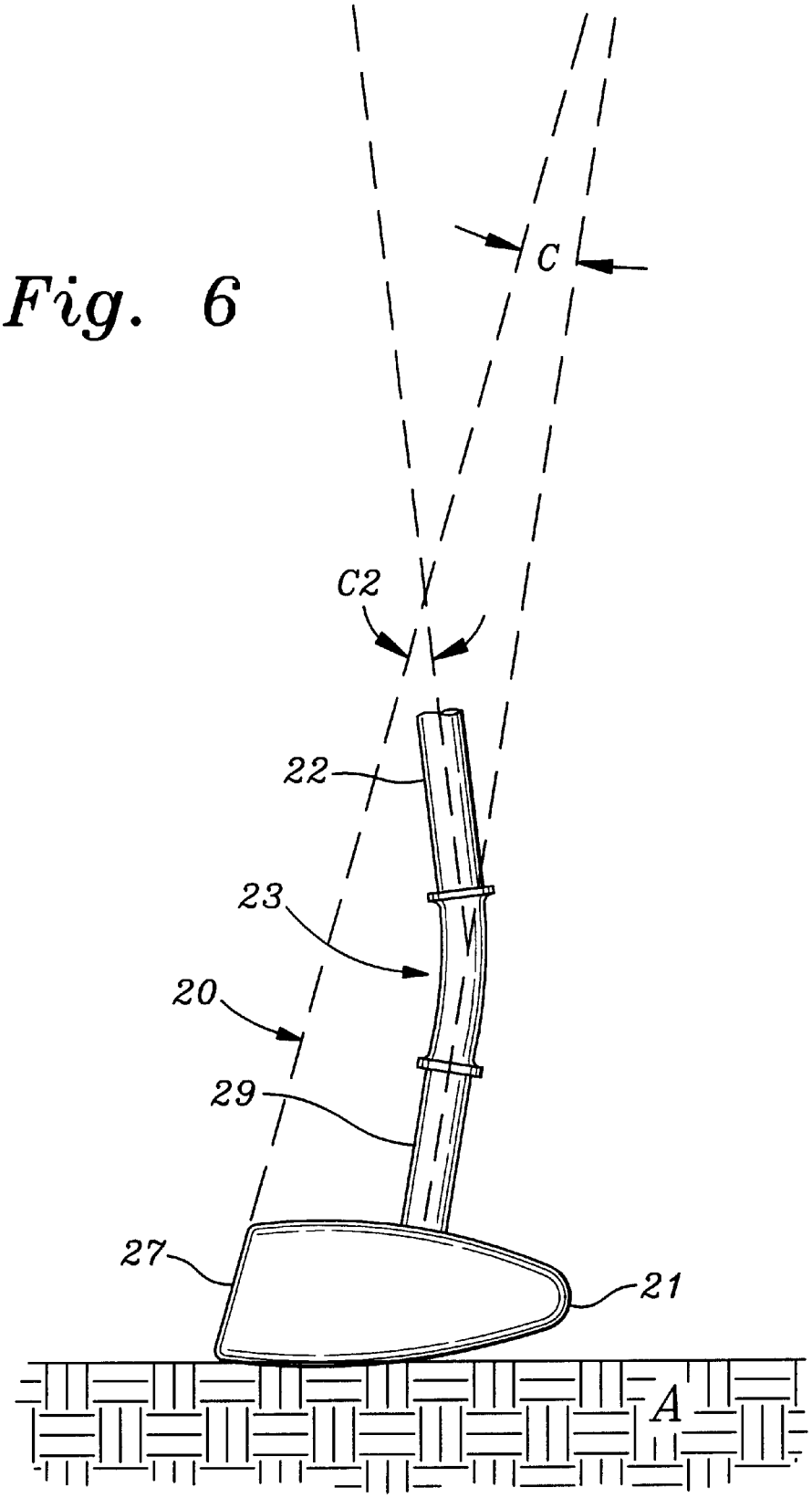
FIG. 6 is a left side elevation view of the putter of FIG. 5.

Referring now to FIGS. 3, 4, and 6, it may be seen that face 26 of putter head 21 is angled rearward towards shaft 22 at a loft angle C. Thus, with shaft 22 of puffer 20 lying in a vertical plane, a direction vector perpendicular to face 26 is angled upwards from the horizontal by a loft angle C. In most cases, loft angle B would be a relatively small acute angle, e.g., 24 degrees for an average golfer assuming an average stance.

As will now be discussed, coupler 23 of putter 20 provides means permitting a golfer to adjust both the lie angle B and loft angle C to suit his or her particular requirements.

Referring now to FIGS. 5–8 in addition to FIGS. 1–2, it may be seen that a coupler 23 according to the present invention includes a longitudinally elongated, hollow cylindrical body 35. Body 35 is made of a material such as stainless steel or other metal which is relatively rigid, but which is sufficiently ductile to allow coupler 23 to bend a number of times without breaking. A discussion of metal properties which may be used to guide selection of a suitable material for coupler 23 may be found in the following two references:

(1) *Processes And Materials Of Manufacture*, Lindberg, Allyn and Bacon, Inc., Boston 1964, pp. 18–22.

(2) *Marks Standard Handbook For Mechanical Engineers*, Eighth Edition, Baumeister (Ed.), McGraw-Hill Book Company, New York, pp. 13–15through 13–16.

In an example embodiment of coupler 23, body 35 of the coupler was made of a length of 1018 cold-rolled steel tubing having disposed axially therethrough a central coaxial bore 42, and having a wall thickness of about 0.080 inch, an average outer diameter of about 0.35 inch and an overall length of about two inches. As shown in FIGS. 5 and 6, coupler 23 has an upper elongated portion 36 having a generally circular cross section and an outer diameter adapted to be received in an interference fit within the bore 37 of shaft 22.

Figure 7A:
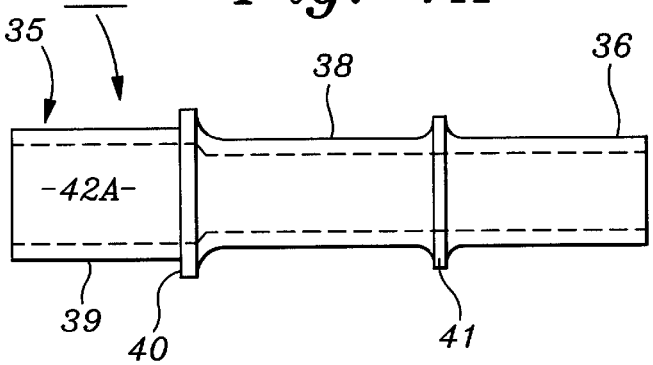
FIG. 7A is a front elevation view of the coupler of FIG. 3, on a further enlarged scale.
Figure 8:
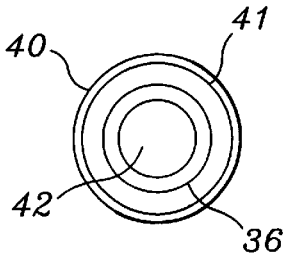
FIG. 8 is a lower end elevation view of the coupler of FIG. 5.

As shown in FIGS. 5–7, coupler body 35 also has a central longitudinal portion 38 and a lower longitudinal portion 39. The latter has a generally circular cross section and an outer diameter adapted to be received in an interference fit within the bore 34 of hosel 29. In the embodiment of coupler 23 shown in FIGS. 5–7, body 35 of the coupler is provided with a lower annular flange 40 which limits the insertion depth of lower portion 39 of the coupler into bore 34 of hosel 29, and an upper annular flange 41 which limits the insertion depth of upper longitudinal portion 36 of the coupler into bore 37 of shaft 22.

Referring now to FIGS. 2 and 5, the central longitudinal portion 38 of coupler 23 located between lower and upper flanges 40 and 41 of the coupler is shown bent to provide a lie angle B2 selected by a golfer to be different from that shown in FIG. 1. Preferably, coupler 23 is bent to provide a selectable lie angle by clamping head 21 of putter 20, or pressing down on the head with a gofer's foot, and grasping and applying force to upper, grip end D of shaft 22 in a direction appropriate to bend the coupler.

Referring now to FIGS. 4 and 6, the central longitudinal portion 38 of coupler 23 located between lower and upper flanges 40 and 41 of the coupler is shown bent to provide a loft angle C2 selected by a golfer to be different from that shown in FIG. 2. Preferably, coupler 23 is bent to provide a selectable loft angle by clamping head 21 of putter 20, or pressing down on the head with the golfer's foot, and grasping and applying force to upper, grip end D of shaft 22 in a desired direction.

Figure 9:
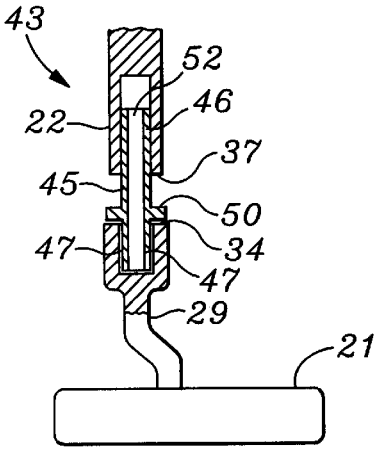
FIG. 9 is a front elevation view of a first modification of an adjustable lie/loft angle coupler according to the present invention.
Figure 10:
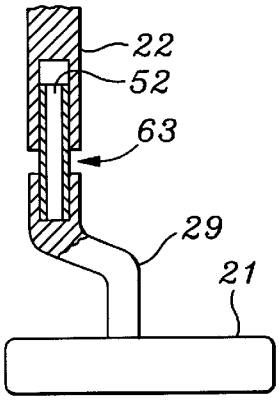
FIG. 10 is a front elevation view of a second modification of an adjustable lie/loft angle coupler according to the present invention.
Figure 11:
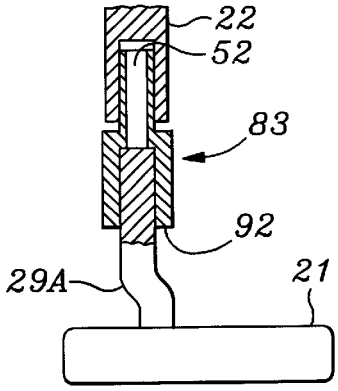
FIG. 11 is a front elevation view of a third modification of an adjustable lie/lot angle coupler according to the present invention.

FIGS. 9–11 illustrate modifications of a golf putter with adjustable lie and loft angles according to the present invention. As shown in FIG. 9, modified coupler 43 includes a bendable body 45 which has a longitudinally elongated, generally cylindrically-shaped upper portion 46, a lower longitudinally elongated portion 47, and an intermediate annular flange portion 50 which joins the upper and lower portions. As in the basic embodiment of a coupler according to the present invention shown in FIGS. 1–8 and described above, upper portion 46 of modified coupler 43 is of a size and shape adapting it to be insertably received in an interference fit within bore 37 of putter shaft 22, and may be secured therein by an adhesive bond, e.g., formed by epoxy cement, and/or with a set screw (not shown) which is threaded through radially aligned bores (not shown) through the shaft and coupler. In a similar fashion, lower longitudinal portion 47 of modified coupler 43 is insertably received and secured in bore 34 of hosel 29. As shown in FIG. 9, flange 50 of modified coupler 43 may be located longitudinally to serve as a stop for limiting the insertion depth of lower portion 47 into boric 34 of hosel 29, bore 37 of shaft 22, or both. Also, the outer cylindrical wall surface of either or both upper and lower longitudinal portions 46 and 47 of coupler 23 may be tapered to smaller end-face diameters, to facilitate installation of the upper and lower end portions of the coupler into the bores of shaft 22 and hosel 29, respectively. In a preferred embodiment of modified coupler 43, body 45 is of a hollow tubular construction.

FIG. 10 illustrates a second modification of a coupler for an adjustable lie/loft angle putter according to the present invention. Modified coupler 63 is similar in construction and function to first modified coupler 43 described above, but does not have a flange.

FIG. 11 illustrates a third modification of a coupler for an adjustable lie/loft angle putter according to the present invention. Modified coupler 83 is similar in construction and function to second modified coupler 63 shown in FIG. 9 and described above. However, modified coupler 83 has a lower longitudinal portion which has a bore 92 which is adapted to insertably receive in an interference fit the upper end of hosel 29A. Thus, modified coupler 83 may be used with a putter head having a solid hosel.

Figure 7B:
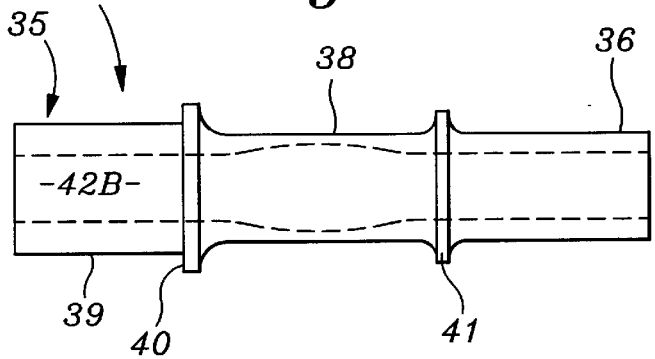
FIG. 7B is a front elevation view of a modification of the coupler of FIG. 7A.

In each of the embodiments of a coupler according to the present invention, the bore through coupler body may be tapered to facilitate bending of the coupler at a desired longitudinal region. Thus, for example, as shown in FIG. 7B, bore 42B of coupler 23B may taper radially outwards towards a larger inner diameter near a central longitudinal portion located between flanges 40 and 41 of the coupler, reducing the wall thickness of the coupler in this region. Therefore, when a sufficiently large bending force is applied between the shaft and head, to adjust the lie or loft angle of putter 20, coupler 23B will bend preferentially at the location where the coupler tube wall is thinner.

Figure 5B:
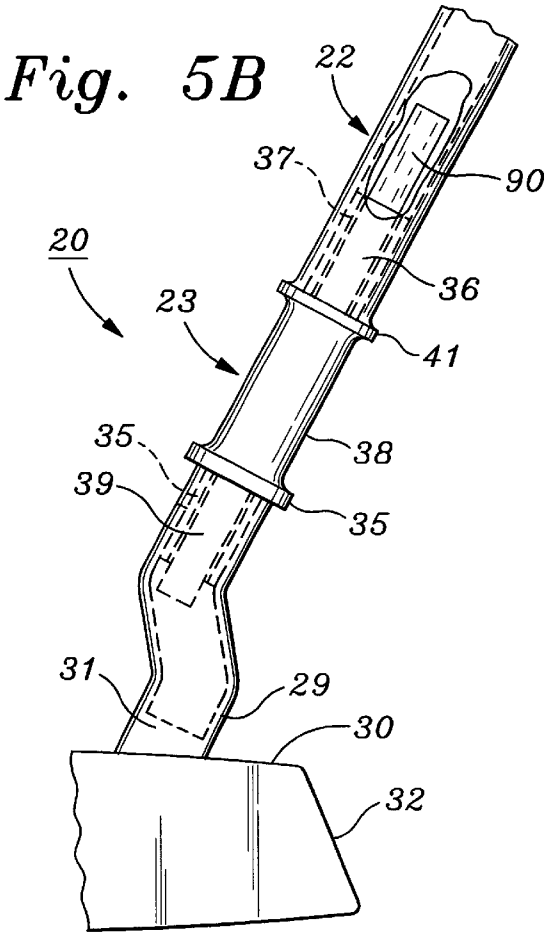
FIG. 5B is a fragmentary front elevation view showing a modification of the putter of FIG. 5.
Figure 5A:
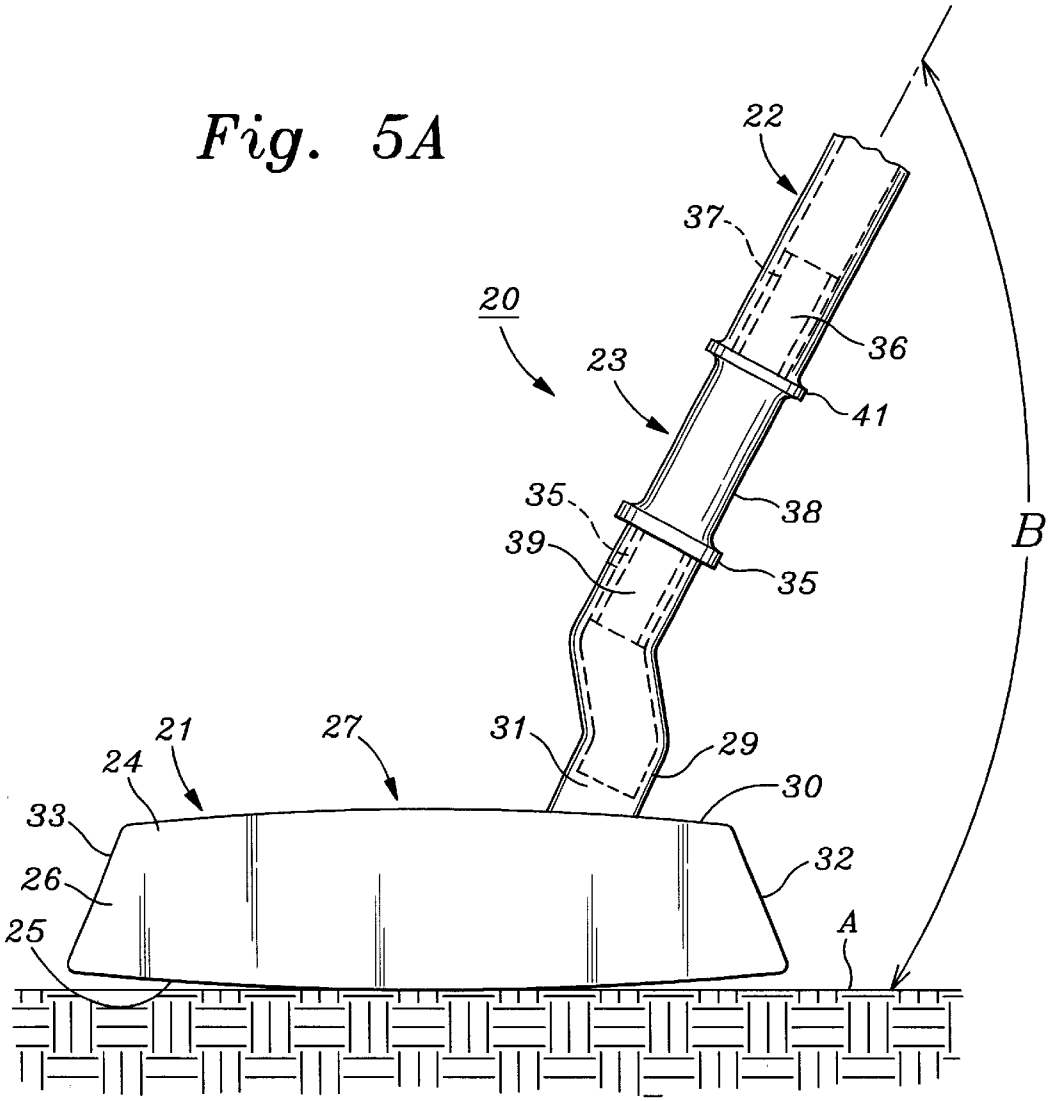
FIG. 5A is a fragmentary front elevation view of the putter of FIGS. 1–4, on a further enlarged scale and showing a coupling element thereof.

Referring now to FIG. 5*b*, it may be seen that bore 42 of coupler 23 of the present invention may enclose an elongated cylindrical slug 90, which may be mode from a variety of materials, to adjust the weight balance, vibration or damping characteristics, and/or to facilitate bending of the coupler without kinking. Thus, slug 90 may be made of various polymers, such as elastomeric polyurethanes, or metals such as lead. As shown in FIG. 5*b*, a slug 90 is longer than coupler 23, extending into the bores of both shaft 22 and hosel 29. However, slug 90 may be of different, shorter lengths, extending only into the bore of shaft 22, hosel 29, or neither. Also, slug 90 may be secured in a desired longitudinal position within coupler 23 by any convenient means, such as an interference fit, adhesive bonding, or set screw.

What is claimed is:

1. A golf putter comprising a hollow shaft having a lower entrance bore, a club head, and a coupling element removably joinable between said shaft and said head, said coupling element being a longitudinally elongated, radially symmetric, hollow tubular member having disposed axially through its entire length a central coaxial bore, said coupling element having an upper longitudinal end portion adapted to be insertably received in said lower entrance bore of said shaft, and a lower longitudinal end portion adapted to be fastened to said club head, said coupling element being made of a plastically deformable material enabling said coupling element to be bent by a first force in a first plane perpendicularly to a lower, sole surface of said club head to thereby adjust a loft angle of said putter, and, by a second force, in a second plane perpendicular to said first plane to thereby adjust a lie angle of said putter.

2. The golf putter of claim 1 wherein said first and second forces are greater than forces encountered by the putter during putting.

3. The gold putter of claim 2 wherein said forces are exertable on said putter by a golfer standing on said club head and manipulating said shaft.

4. The gold putter of claim 1 wherein said coupling element is further defined as being bendable to at least two different respective angles without fatigue damage to any component of said putter.

5. The gold putter of claim 4 wherein said coupling element is further defined as being bendable to at least two different respective loft angles without fatigue damage to any component of said putter.

6. The golf putter of claim 1 wherein said coupling element is further defined as being bendable to at least two different loft angles and two different lie angles without fatigue damage to any component of said putter.

7. The golf putter of claim 1 wherein said lower longitudinal end of said coupling element is further defined as being adapted to be received in an upper entrance bore provided in said club head.

8. The golf putter of claim 7 wherein said club head is further defined as having an upward protruding hosel in which is located said upper entrance bore.

9. The golf putter of claim 8 wherein said coupling element is further defined as having a first lower flange which protrudes radially outwardly from said body of said coupling element, to thereby limit the insertion depth of said coupling element into said upper entrance bore of said club head.

10. The golf putter of claim 9 further including a second, upper flange which protrudes radially outwardly from said body of said coupling element, to thereby limit the insertion depth of said coupling element into said lower entrance bore of said shaft.

11. The golf putter of claim 8 wherein said coupling element is further defined as having an upper flange which protrudes radially outwardly from said body of said coupling element to thereby limit the insertion depth of said coupling element into said lower entrance bore of said shaft.

12. The golf putter of claim 1 wherein said putter head is further defined as having protruding upwardly from an upper surface thereof a solid hosel.

13. The golf putter of claim 12 wherein said lower longitudinal end portion of said coupling element is further defined as having therein an enlarged entrance bore adapted to insertably receive said hosel.

14. The golf putter of claim 1 wherein said coupling element comprises a one-piece unitary element.

15. The golf putter of claim 14 wherein said coupling element is joinable between said shaft and said head without any additional elements.

16. The golf putter of claim 16 wherein said upper longitudinal end portion of said coupling element has an outer diameter adapted to make an interference fit within said lower entrance bore of said shaft.

17. The golf putter of claim 16 wherein said lower longitudinal portion of said coupling element has an outer diameter adapted to be insertably received within a bore provided in the upper surface of said club head.

18. The golf putter of claim 16 wherein said lower longitudinal portion of said coupling element has an inner diameter adapted to insertably receive a projection protruding upwardly from said club head.

19. The putter of claim 1 further including a vibration damping/weight adjusting member contained at least partially within said coaxial bore of said coupling element.

20. The putter of claim 19 wherein said vibration damping/weight adjusting member is further defined as being softer than said coupling element.

21. The putter of claim 20 wherein said vibration damping/weight adjusting member is further defined as being a polymer.

22. A coupling element removably joinable between a hollow golf putter shaft and a golf putter head, said coupling element being a longitudinally elongated radially symmetric hollow tubular member having disposed axially through its entire length a central coaxial bore, said coupling element having an upper longitudinal end portion adapted to be insertably received in a lower entrance bore provided in said shaft, and a lower longitudinal portion adapted to being fastened to said putter head, said coupling element being made of a plastically deformable material enabling said coupling element to be bent by externally applied forces in directions radially displaced from a central longitudinal axis of said coupling element, to thereby adjust lie and loft angles of said putter head relative to said shaft.

23. The coupling element of claim 22 wherein said first and second forces are greater than forces encountered by the putter during putting.

24. The coupling element of claim 22 wherein said longitudinal end of said coupling element is further defined as being adapted to be received in an upper entrance bore provided in said club head.

25. The coupling element of claim 24 wherein said coupling element is further defined as having a first lower flange which protrudes radially outwardly from said body of said coupling element, to thereby limit the insertion depth of said coupling element in said upper entrance bore of said club head.

26. The coupling element of claim 25 further including a second, upper flange which protrudes radially outwardly from said body of said coupling element, to thereby limit the insertion depth of said coupling element into said lower entrance bore of said shaft.

27. The coupling element of claim 24 wherein said coupling element is further defined as having an upper flange which protrudes radially outwardly from said body of said coupling element to thereby limit the insertion depth of said coupling element into said lower entrance bore of said shaft.

28. The coupling element of claim 22 wherein said lower longitudinal end portion of said coupling element is further defined as having therein an enlarged entrance bore adapted to insertably receive a hosel.

29. The coupling element of claim 22 wherein said coupling element comprises a one-piece unitary element.

30. The coupling element of claim 29 wherein said coupling element is joinable between said shaft and said head without any additional elements.

31. The coupling element of claim 30 wherein said upper longitudinal end portion of said coupling element has an outer diameter adapted to make an interference fit within said lower entrance bore of said shaft.

32. The coupling element of claim 31 wherein said lower longitudinal portion of said coupling element has an outer diameter adapted to be insertably received within a bore provided in the upper surface of said dub head.

33. The coupling element of claim 30 wherein said lower longitudinal portion of said coupling element has an inner diameter adapted to insertably receive a projection protruding upwardly from said club head.

34. The coupling element of claim 22 wherein said hollow tubular member is further defined as being so constructed as to enable preferential bending of a particular longitudinal region of said coupling element in response to said externally applied forced.

35. The coupling element of claim 22 wherein said hollow tubular member is further defined as having a wall thickness reduced at a longitudinal region thereof to thereby enable preferential bending thereof.

* * * * *